United States Patent [19]

Faulkner et al.

[11] 3,974,411

[45] Aug. 10, 1976

[54] CHANNEL PLATE ELECTRON MULTIPLIER TUBE HAVING REDUCED ASTIGMATISM

[75] Inventors: Richard Dale Faulkner, Lancaster; Charles Michael Tomasetti, Turnersville, both of Pa.

[73] Assignee: RCA Corporation, New York, N.Y.

[22] Filed: Sept. 20, 1970

[21] Appl. No.: 78,335

[52] U.S. Cl. ..... 313/105 CM

[51] Int. Cl.[2] ..... H01J 43/00

[58] Field of Search ..... 315/11, 12; 313/68, 313/103, 104, 105 CM, 105

[56] References Cited

UNITED STATES PATENTS

| | | | |
|---|---|---|---|
| 3,235,765 | 2/1966 | Goodrich et al. | 315/12 |
| 3,487,258 | 12/1969 | Manley et al. | 315/11 |
| 3,497,759 | 2/1970 | Manley | 315/11 |
| 3,555,345 | 1/1971 | Collings | 313/68 |

*Primary Examiner*—Maynard R. Wilbur
*Assistant Examiner*—T. M. Blum
*Attorney, Agent, or Firm*—G. H. Bruestle; D. S. Cohen

[57] ABSTRACT

Electron discharge device including a channel plate electron multiplier provided on its output face with a conducting layer of which substantially annular end-spoiling segments extend a distance into the channels. The ends of the endspoiling segments are slanted in the same direction, and to at least the same degree of magnitude, as are the channels themselves with respect to the output face.

5 Claims, 2 Drawing Figures

Fig. 1.
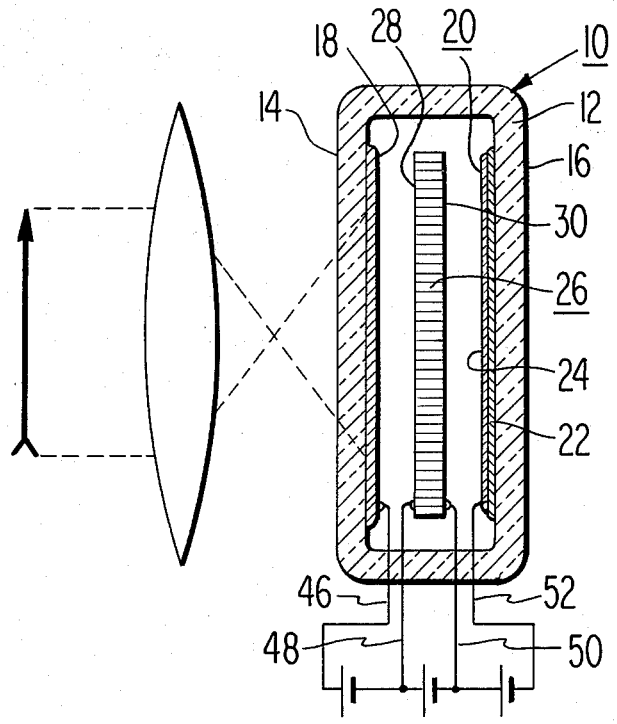
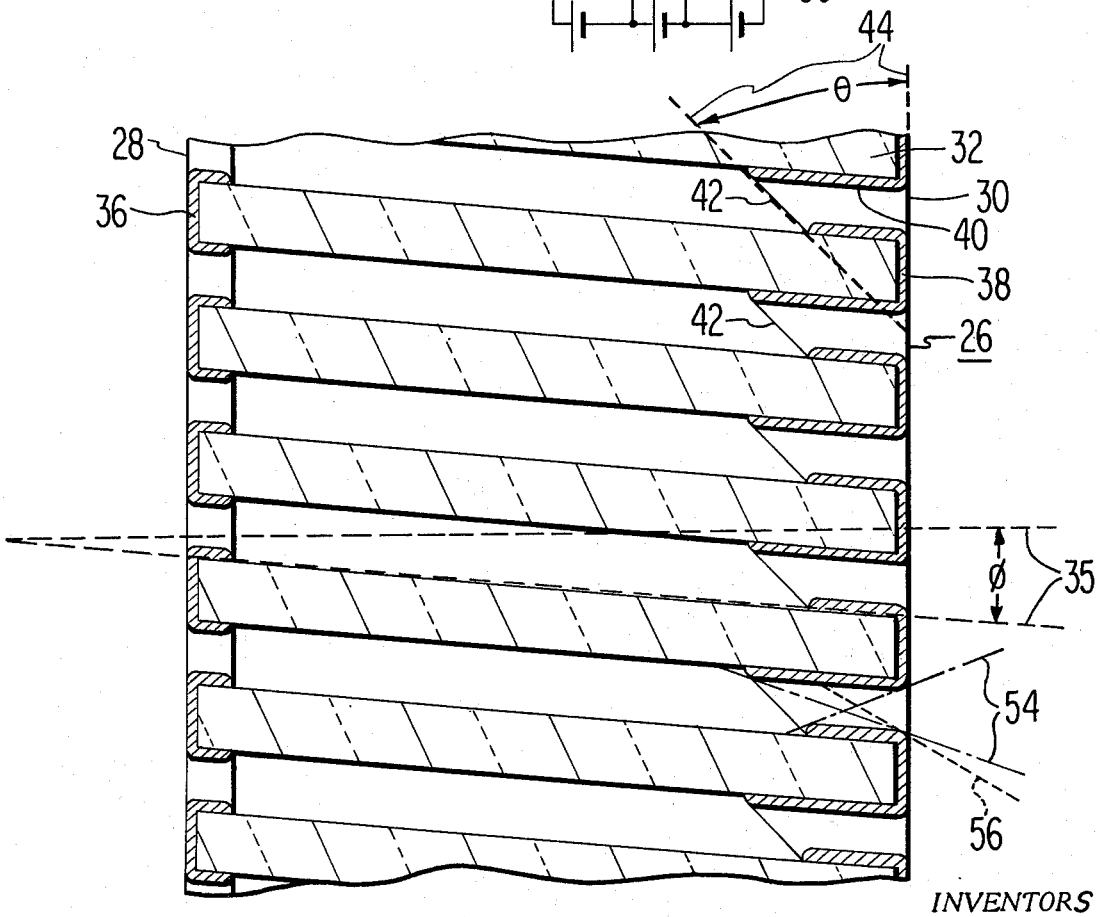
Fig. 2.
INVENTORS
Richard D. Faulkner &
BY Charles M. Tomasetti
Volker R. Ulbrich
ATTORNEY

CHANNEL PLATE ELECTRON MULTIPLIER TUBE HAVING REDUCED ASTIGMATISM

The invention disclosed herein was made in the course of, or under, a contract or subcontract thereunder with the Department of the Army.

BACKGROUND OF THE INVENTION

The invention relates generally to electron discharge tubes and particularly to tubes of the type wherein an electron image is intensified by passage through a channel plate electron multiplier.

Electron image intensifying tubes such as image tubes may include a channel plate electron multiplier. Such tubes are described in detail in, for instance, U.S. Pat. Nos. 3,260,876 and 3,487,258 both to B. W. Manley et al and U.S. Pat. No. 3,497,759 to B. W. Manley. A proximity focussed image tube generally includes a flat photocathode and a flat phosphor screen facing one another in an evacuated flat glass envelope. Spaced between the photocathode and the phosphor screen is a thin, flat channel plate whose faces are parallel to, and closely spaced from, the photocathode and phosphor screen. The channel plate has a large number of small, round, parallel channels extending from one face to the other. The channels are slanted at a bias angle of about 5° with respect to the input and output faces of the plate. Both input and output faces are provided with a conducting electrode such as a coating of chromium. The inside surfaces of the channels are activated with hydrogen to increase secondary emission.

In operation of the tube, appropriate accelerating voltages are applied to the photocathode, the input electrode of the plate, the output electrode of the plate, and the phosphor screen, so that electrons from the photocathode strike the inside walls of the channels, are multiplied, while travelling through the channels exit at the output face of the plate, and strike the phosphor screen to produce a visible output image.

Increased spacing of the output screen from the output electrode of the plate permits a higher accelerating voltage to be applied between the output electrode and screen, and thus further increases the intensity of the output image without increasing risks of charging of the tube walls or causing high field breakdown. However, such increased spacing results in decreased resolution since the beam of electrons from individual channels rapidly spreads as it leaves the output face of the plate. Beyond a short distance, on the order of mils, beams from adjacent channels overlap. Such decreased resolution has, nevertheless, been avoided by endspoiling of secondary emission near the channel end at the output face to effectively decrease the output aperture of the channels. In previous devices, endspoiling is provided by extending the output electrode metallizing a uniform short distance into the end channel so that no multiplication can occur near the output face. The endspoiling in effect collimates each of the output beams from the channels.

The detection efficiency of the input image can also be increased by increasing the bias angle of the channels. Increase in bias angle also results in increased multiplication since there are then a larger number of electron impacts near the input of the channel. However, slant of the channels with respect to the output phosphor screen, results in astigmatism. That is, the output beam from each channel strikes an elongated spot on the output screen rather than a round spot, much as a round light beam impinging on a surface at an angle illuminates an elongated spot. The astigmatism decreases resolution with increasing bias angles of the channels and with increased spacing of the output screen from the channel plate.

SUMMARY OF THE INVENTION

The novel device comprises a channel plate electron multiplier with slanted endspoiling on the output face of the channel plate. In the novel device, slanted endspoiling is provided by extending the output electrode a non-uniform distance, shorter on one side and longer on the other, into the end of each channel. The end of each annular endspoiling segment lies substantially in one of a set of parallel planes which are slanted with respect to the output face in the same direction as, and at least to the same degree of magnitude as the channels are slanted with respect to the output face.

The novel device has substantially reduced astigmatism due to channel bias. Therefore, a relatively lar bias angle plate may be used together with a relativ large spacing between the output electrode and output screen. As a result, intensification is increa without substantial loss of resolution due to astig tism.

BRIEF DESCRIPTION OF THE DRAWING

FIG. 1 is a sectional view of an image tube acc to the preferred embodiment of the invention.

FIG. 2 is an exaggerated sectional view of a fr of a channel plate multiplier of the tube of FIG

PREFERRED EMBODIMENT OF THE INVI

The preferred embodiment of the invention imity focussed image tube 10 shown in FIG drawings. The tube 10 includes an evacu envelope 12 with two closely spaced parallel 14, 16. One of the faceplates, the input fa has a photocathode 18 deposited on the ins The other faceplate, the output faceplate output screen 20 deposited on the inside output screen 20 is a layer of phosphor 22 a thin aluminum layer 24, which preven sion of light and ion damage to the phos Spaced between the photocathode 18 a screen 20 is a channel plate electron having an input face 28 toward the pl and an output face 30 toward the out output face 30 is spaced at a distance from the output screen 20.

A section of a fragment of the ch shown in FIG. 2. Referring now to FI ing structure of the channel plate 2 lead glass 32 about 1 millimeter thic in diameter. A large number o through the disc. The channels 34 a in diameter and are spaced fron distance of about 1 mil. The cha one another and are oriented at a 5° with respect to the faces 28, shown in the drawing of the FIG The input face 28 is covered wit which is a thin layer of chromi distance into the channels. Th covered with an output electr chromium. The output electr nular endspoiling segments 4 distance of about three cha spoiling segment ends 42 are slanted respect to the output face 30 in the same direction as the channels are slanted with respect to the faces 14, 16. The slant angle $\theta$ of the endspoiling ends 42 with respect to the faces 14, 16 is shown in the FIG. 2 by dashed lines. The layer thickness of the output electrode 30 is on the order of several microns.

For operation of the tube 10, voltages of 0, +500, +1000, and +6000, are applied to the leads 46, 48, 50, 52 respectively, which connect to the photocathode 18, the input electrode 36, the output electrode 38, and the output screen 20 respectively.

The input and output electrodes 36, 38 may be deposited by off-axis evaporation from beads of a nickel-rome alloy, or by rotation of the plate during the poration. To provide the slant to the endspoiling s 42, the axis of rotation of the evaporation source e axis of the plate itself rather than the axis of the nels. Therefore, the plate should not be tilted with ct to the axis of rotation for the evaporation to ensate for the bias. It may, however, be tilted in posite direction to increase further the angle $\theta$ to le greater than the bias angle $\phi$ of the channels spect to the plate faces 28, 30.

General Considerations fect of the slanted endspoiling is that the angu-ution of the emerging electrons is primarily in n perpendicular to the output face, thereby n a round, rather than an oval, spot on the een. It may be seen from the solid projection FIG. 2 that the aperture of the channels is ally limited by the slanted endspoiling seg-ding into the channels so that the astigma-he channel bias angle is compensated for. line 56 illustrates divergence of electrons atism which would be present if the end-not slanted.

ions of the channels and of the output oo small to permit determination as to lative angular orientations. However, it he endspoiling ends inside the channels v in a set of parallel planes which are at espect to the output face of the chan-wn in the FIG. 2. For the preferred angle $\theta$ was found to be 42°. How-s also reduce astigmatism. For plates nel bias, the optimum slant angle $\theta$ reater. In any case, the slant angle $\theta$ should be at least as great in magnitude as is the bias angle $\phi$ of the channels.

Although in the preferred embodiment the tube is a proximity focussed tube, it is to be understood that the slanted endspoiling at the output face of a channel plate is applicable to any tube in which the resolution of the electron image from the output face of a channel plate is important. Other types of image tubes, such as magnetically focussed and electrostatic lens focussed tubes, as well as the various intensifier type camera tubes are in this category.

We claim:

1. An electron discharge tube of the type including:

an envelope having an evacuated interior space;

an electron source which emits electrons into said evacuated space, and a channel plate electron multiplier comprising an electrically insulating plate having an input face upon which said emitted electrons are incident and an output face from which multiplied electrons emerge, said multiplier having a plurality of parallel channels extending from said input face to said output face, that portion of said channels near said output being slanted with respect to said output face, said input and output faces each having an electrically conducting layer thereon, wherein the improvement comprises that:

a substantially annular segment of said conductive layer on said output face extends into each of said channels, the end of each annular segment being similarly slanted with respect to said output face in the same direction as and at least to the same degree of magnitude as said channel is slanted with respect to said output face.

2. The device defined in claim 1 and wherein said channels are parallel to one another.

3. The device defined in claim 1 and wherein the angle between said channel and said output face is at least about 5°.

4. The device defined in claim 3 and wherein said end of each annular segment is slanted at least about 5° with respect to said output face.

5. The device defined in claim 1 and wherein said channels are substantially round and said annular portion of said conductive layer extends into each of said channels an average distance of at least 2 diameters of said channel.

* * * * *

UNITED STATES PATENT OFFICE
CERTIFICATE OF CORRECTION

PATENT NO. : 3,974,411

DATED : August 10, 1976

INVENTOR(S) : Richard Dale Faulkner et al

It is certified that error appears in the above-identified patent and that said Letters Patent are hereby corrected as shown below:

Title Page, Item [22], "Sept. 20, 1970" should be --Sept. 2, 1970--.

Signed and Sealed this

Second Day of November 1976

[SEAL]

*Attest:*

RUTH C. MASON
*Attesting Officer*

C. MARSHALL DANN
*Commissioner of Patents and Trademarks*